United States Patent [19]

Del Bon

[11] Patent Number: 4,522,318

[45] Date of Patent: Jun. 11, 1985

[54] DISCHARGE VALVE FOR USE IN A PRESSURIZED CONTAINER

[76] Inventor: Luigi Del Bon, 141 Feldstrasse, 4663 Aarburg, Switzerland

[21] Appl. No.: 490,658

[22] Filed: May 2, 1983

Related U.S. Application Data

[63] Continuation-in-part of Ser. No. 218,084, Dec. 19, 1980, abandoned.

[51] Int. Cl.[3] ..... B65D 83/14

[52] U.S. Cl. ..... 222/402.24; 222/518

[58] Field of Search ..... 222/206, 212, 213, 394, 222/402.1, 402.23, 402.24, 402.25, 518, 529, 494, 513, 514, 527; 251/320; 137/525

[56] References Cited

U.S. PATENT DOCUMENTS

| | | | |
|---|---|---|---|
| 2,744,665 | 5/1956 | Carlson et al. | 222/518 X |
| 2,839,225 | 6/1958 | Soffer et al. | 222/402.24 X |
| 2,975,944 | 3/1961 | Michel | 222/402.23 |
| 3,169,672 | 2/1965 | Soffer et al. | 222/402.24 X |
| 3,675,832 | 7/1972 | Ruscitti | 222/402.24 |
| 3,977,575 | 8/1976 | Macquire-Cooper | 222/396 |
| 4,390,160 | 6/1983 | Reed | 251/149.6 |

*Primary Examiner*—Joseph J. Rolla
*Assistant Examiner*—Michael S. Huppert
*Attorney, Agent, or Firm*—Heinrich W. Herzfeld

[57] ABSTRACT

A self-closing discharge valve for use in a pressurized container from which a liquid product is to be dispensed, with the aid of a propellant, in liquid, pasty or foamy condition, which valve opens automatically when an external part thereof is moved in a given direction, and comprises (a) as said external part, a tubular actuating member having an outlet orifice, an intake orifice for product into the valve; and a tubular passage connecting the two orifices;

(b) an obturating member displaceable between an open position and a closed position, in the tubular passage and having an obturating head obturating the intake orifice, and (c) a spring-like elastically resilient portion of the actuating member for biassing the actuating and obturating members toward closed position when the valve is brought into open position;

whereby, when the actuating tube is moved toward inward position, the intake orifice is opened.

2 Claims, 2 Drawing Figures

12
21
23
11
20
15
30a
19
33
13a
18a
16
17a
18
-25-
14
17
32
31
30
20a
22
21
15

12
10
23
15
19
30a
13
13a
16
17a
18
11
22
20a
18a
17
32
31
30
-25-
20

DISCHARGE VALVE FOR USE IN A PRESSURIZED CONTAINER

RELATIONSHIP TO EARLIER PATENT APPLICATION

This application is a continuation-in-part of my pending patent application Ser. No. 218,084 filed Dec. 19, 1980, now abandoned.

BACKGROUND OF THE INVENTION

This invention relates to a self-closing discharge valve for use in a pressurized container from which a liquid product is to be dispensed, with the aid of a propellant, in liquid, pasty or foamy condition, which valve opens automatically when an external part thereof is moved in a given direction.

Such valves are numerous, but show certain drawbacks. They require usually a plurality of parts, among them at least one spring which is usually made of steel wire. Moreover, from many of the known valves, product such as a shaving lather foam, is ejected suddenly in an undesirably large quantity, especially in the initial stages of using a new pressurized can, while the propellant pressure inside the can is still high.

Also, in many cases it is practically impossible to empty the can completely from product stored therein. In other cases, it is not possible to obtain a product discharge when the can is held in upside down position.

A poppet valve comprising only two parts, namely, a tubular outer nozzle member having a flexible wall zone in its central region, and an inner, rigid valve stem, an obturating poppet head at the inner end and prongs forming anchoring means, at the outer end of the stem, has been described in U.S. Pat. No. 2,954,903 to Collins, and a similar patent further comprising a bellows in the said flexible zone is described in U.S. Pat. No. 2,975,944 to Michel. In these valves the poppet head may not free the entry passage from the interior of the pressurized container into the tubular passage in the nozzle member, especially when higher excess pressures of up to 10 bars prevail in the container unless there is applied a very pronounced angular deflection of the nozzle member.

OBJECTS AND SUMMARY OF THE INVENTION

In contrast thereto it is a first object of the instant invention to provide a novel discharge valve of the initially described type which will open readily even when only axial downward pressure is applied to a tubular outer actuating member without requiring tilting, and even at very high excess pressure in the interior of the container.

It is another object of the instant invention to provide a novel discharge valve of this kind which is of particularly simple structure and free from metallic spring means.

Further objects of the invention are to provide a discharge valve which permits use of the pressurized can, in which it is mounted, in upside down position, which permits complete emptying of the can from product contained therein, easy refilling of the can with product if desired, and avoidance of the sudden ejection of an undesirably large amount of product from the can; as well as a particularly supported valve seat at the inner end of the actuating member, ensuring a hermetic seal when the valve stem head is in closed position.

These objects are attained in accordance with the invention in a discharge valve of the initially described type, which comprises (a) a tubular actuating member constituting the external part and having a substantially rigid upper end portion having an outlet orifice for the product, a substantially rigid lower end portion having an intake orifice for product into the valve, a tubular passage having an inner passage wall and connecting the two orifices at all times, a valve seat about the intake orifice; and annular recess means extending radially outwardly from the tubular passage into the inner wall thereof in an anchoring zone in the rigid upper end portion;

(b) an elongated obturating member lodged in the tubular passage spaced fom the inner passage wall to permit flow of product through the passage toward the outlet orifice, the obturating member axially displaceable, relative to the lower end portion of the actuating member, between an open position and a closed position, the obturating member having an upper and a lower end and comprising radially extending anchoring arm means projecting into said annular recess means so as to positively secure the outer end of the arm means therein, against axial displacement in the upper end portion of the butular passage, but permitting passage of product through the anchoring zone at all times, the lower end of the obturating member comprising an obturating head sealingly enganging the valve seat, when in closed position, the said tubular actuating member further comprising, (c) an elastically foldable wall zone, intermediate the anchoring zone and the valve seat, and adapted for acting as spring means, whereby, upon downward axial force being exercised on the actuating member to compress the foldable wall zone and thereby shortening the actuating member, the upper end of the actuating member forces the obturating member downward in unison therewith so that the obturating head is disenagaged from the valve seat in downward direction and frees the tubular passage for product flow therethrough, and (d) fastening means on the outside of the actuating member being adapted for fixedly connecting the tubular actuating member, at a zone thereof below the elastically foldable wall zone, with the lid when mounting the valve in the lid opening.

Preferably, the actuating tube has a conically inwardly tapered valve seat about the intake orifice or which seat the obturating head of the obturating member sits sealingly when in closed position.

As spring means, the actuating tube preferably comprises an elastically foldable wall zone constituting a single, outwardly projecting bulge, whereby, upon force being exercized on the actuating tube to disengage the obturating head from the inlet orifice, the foldable wall zone is readily compressed with corresponding axial shortening of the actuating tube. The obturating member preferably comprises anchoring arms for rigidly anchoring the obturating member in the actuating tube, which arms engage the actuating tube in the anchoring zone thereof on the side of the foldable wall zone adjacent the outlet orifice, but remote from the intake orifice.

In a preferred embodiment of the discharge valve according to the invention, each of the actuating tube and the obturating member is an integral part made of synthetic plastic material. In another embodiment of the discharge valve, the obturating member is integrally made of synthetic hard plastics material, while the actuating tube consists essentially of two rigid tubular parts each made intergrally of synthetic hard plastics material, and of a deformable annular wall part made of elastically deformable synthetic plastics material, one of the said rigid tubular parts comprising at one end thereof the inlet orifice, and having its other end joined to one end of the annular wall part, the other end of the deformable annular wall part being joined to the other rigid tubular part which contains at its free end the outlet orifice.

A valve-and-lid assembly in which a novel self-closing discharge valve as described thereinbefore is mounted in the opening in the lid of a pressurized container preferably comprises, about the said lid opening, a downwardly depending sleeve portion of the lid having an internal passage therethrough and radially outwardly recessed groove means therein in which the fastening means of the tubular actuating member are firmly lodged, the sleeve portion further having, downwardly from the groove means, a tubulure portion snugly surrounding the substantially rigid lower end portion of the actuating member over substantially the entire length thereof, thereby enhancing the rigidity of the valve seat and ensuring a good seal with the obturating head in the closed position.

BRIEF DESCRIPTION OF THE DRAWING

Further details of the discharge valve according to the invention will be explained in the following description of preferred embodiments of the same illustrated in the accompanying drawing, in which.

Figure 2:
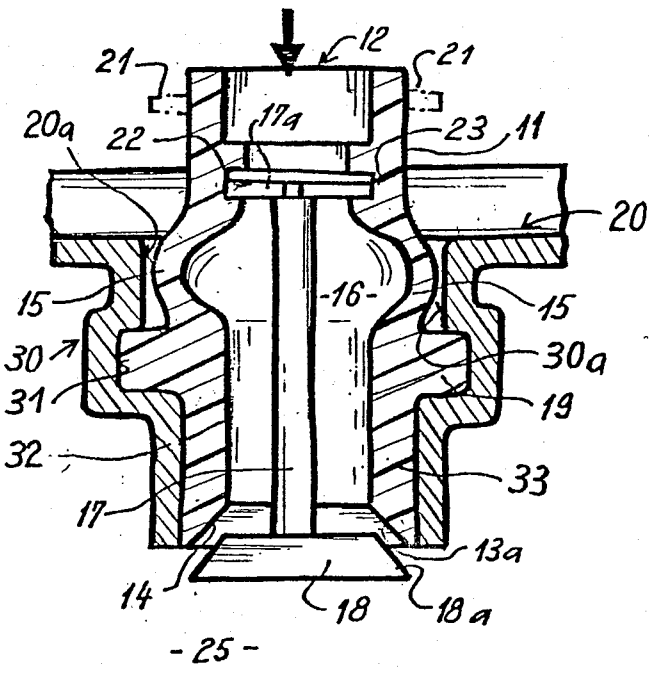
FIG. 2 shows a similar view, but with the parts in "open" position.

The terms "upper" and "lower" and the like in the following description of the drawing refer to the position of parts shown in the figures of the drawing. "Outward" and "inward" and the like terms refer to the direction of movement away from or toward the interior of the pressurized can in the wall of which the discharge valve according to the invention is mounted.

DETAILED DESCRIPTION OF THE EMBODIMENT SHOWN IN THE DRAWING

The preferred embodiment of a discharge valve according to the invention, illustrated in the drawing, comprises an actuating tube 10 serving as the valve housing. This tube has a stiff upper or outer tube portion 11 ending in an outlet orifice 12, a stiff lower or inner tube portion 13 ending in an intake orifice 14, and a deformable, in particular a foldable annular wall zone 15, of reduced thickness compared with the thickness of the outer and inner tube portions of actuating tube 10.

Figure 1:
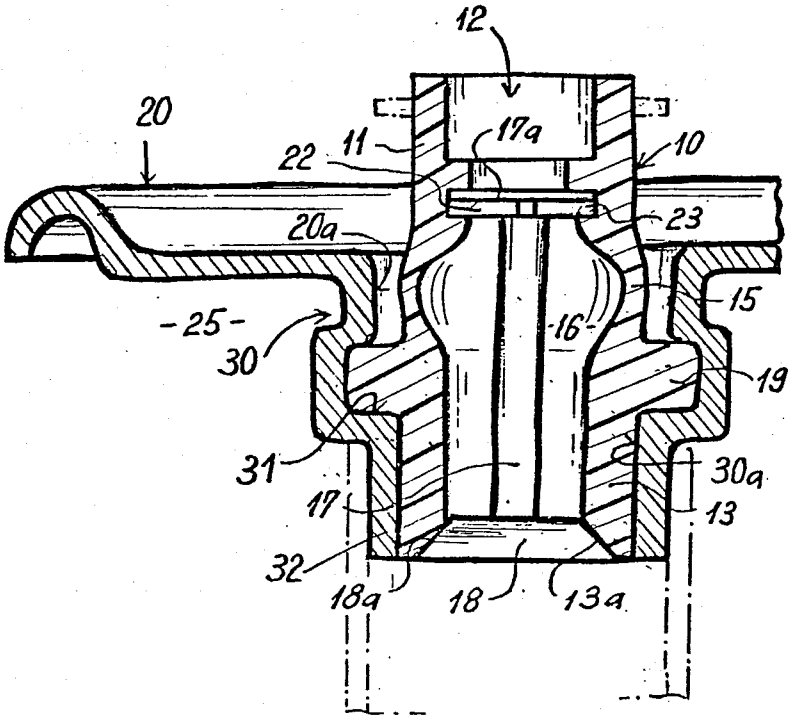
FIG. 1 shows an axial sectional view of a preferred embodiment of the discharge valve according to the invention, with the parts in "closed" position.

The tube 10 has a central passage 16 connecting the intake orifice 14 with the outlet orifice 12, and an obturating member 17 serving as a valve body is lodged axially in the central passage 16. At its inner or lower end, obturating member 17 bears an obturating head 18 which protrudes from the inner end of central passage 16 and has a conically bevelled underside **18*a* which, in closed position as shown in FIG. 1, sealingly engages a valve seat 13*a* which is provided as a conically inwardly tapered surface about the intake orifice 14 in the frontal end face of inner tube portion 13**.

At its end **17*a* remote from intake orifice 14, at the level of stiff outer tube portion 11, the obturating member 17 bears still radially extending arms or pins 22 the free ends of which are lodged in corresponding holes or, preferably, an annular groove 23 in the inner sidewall, surrounding central passage 16, of the outer tube portion 11, whereby obturating member 17 is caused to follow axial displacement of the outer tube portion 11**.

On its sidewall the inner tube portion 13 bears an annular flange 19 adjacent the end of portion 13 to which is joined the flexible wall zone 15.

By means of this flange 19, the valve can be rigidly and sealingly mounted in a conventional manner in the lid 20 of a pressurized can.

Operation of the discharge valve to move it from the 37 closed" position shown in FIG. 1 to the "open" position shown in FIG. 2 requires pressure having an axial component applied, for instance, with fingers of a user's hand on finger rests 21 or the like means provided on the sidewall of outer tube portion 11. Depression of finger rests 21 moves the outer tube portion 11 and in unison therewith the obturating member 17 inwardly toward the interior 25 of the pressurized can.

As the lower or inner tube portion 13 is held fast by means of flange 19 in the can lid 20, it cannot follow this downward movement, deformable wall 15 is folded, and obturating head 18 is moved out of engagement with valve seat **13*a* and opens the intake orifice 14** in the form of an annular gap.

It is not critical that the pressure applied on outer tube portion 11 is exactly perpendicular thereto. The valve will also be opened when the pressure applied is not uniform, as the wall zone 15 will absorb even a slight tilting of tube portion 11.

When finger pressure on the finger rests 21 of upper portion 11 is partially relieved or ceases completely, the spring action of folded wall zone 15 will cause this wall zone to stretch and thereby to pull obturating member 17 upward and obturating head 18 with its bevelled surface **18*a* into hermetically sealing engagement with conical valve seat 13*a***. Internal propellant pressure inside the can will assist in holding intake orifice firmly closed.

It will be apparent from the above description of the preferred structure of the discharge valve in connection with the drawing that the valve can be made of only two parts, that it will operate regardless of the position of the can in which it is mounted, and regardless of the degree of product filling still present in the can, especially if the product is to be dispensed in liquid or pasty form.

It is also very easy to refill an empty can, by connecting a hose or pipe from a product storage tank to the outlet orifice 12 and depress outer tube portion 11 as described above. Fresh liquid product can then flow through the central passage 16 and enter the can interior by way of open intake orifice 14.

Preferably the two parts of the discharge valve according to the invention are made of a synthetic polymeric resin material, such as polyethylene, polypropylene or polyvinyl chloride. The material must be elastic to ensure the spring action of wall zone 15.

The lid 20 as illustrated in FIGS. 1 and 2 has a lid opening **20*a*** in which the discharge valve is mounted so as to close the opening hermetically when the parts of the valve itself are in closed position.

The lid 20 comprises a downwardly depending sleeve portion 30 having an internal passage **30*a* and a radially outwardly extending annular groove 31 in which the fastening flange 19 of the tubular actuating member 10** is firmly lodged. Downward from the groove 31, the sleeve portion 30 has a tubulure portion 32 which snugly surrounds the substantially rigid lower end portion 33 of the actuating member 10, preferably over the entire length of this portion 33. Thereby, the rigidity of the valve seat 14 is greatly enhanced and a better seal is ensured between the obturating head 18 and the valve seat 14.

I claim:

1. A discharge valve-and-lid assembly comprising a lid adapted for closing a pressurized container from which a liquid product is to be dispensed, with the aid of a propellant, said lid having an opening therein, and a self-closing discharge valve mounted in said opening of said lid, said valve comprising (a) a tubular actuating member having a substantially rigid upper end portion having an outlet orifice for the product, a substantially rigid lower end portion having an intake orifice for product into the valve, a tubular passage having an inner passage wall and connecting said two orifices at all times, a valve seat about said intake orifice; and annular recess means extending radially outwardly from said tubular passage into said inner wall thereof in an anchoring zone in said rigid upper end portion;

(b) an elongated obturating member lodged in said tubular passage spaced from said inner passage wall to permit flow of product through said passage toward said outlet orifice, said obturating member being axially displaceable, relative to said lower end portion of said actuating member, between an open position and a closed position, said obturating member having an upper and a lower end and comprising radially extending anchoring arm means projecting into said annular recess means so as to positively secure the outer end of said arm means therein against axial displacement in the upper end portion of said tubular passage, but permitting passage of product through said anchoring zone at all times, the lower end of said obturating member comprising an obturating head sealingly engaging said valve seat, when in closed position, said tubular actuating member further comprising, (c) an elastically foldable wall zone, intermediate said anchoring zone and said valve seat, having at least one bulge and adapted for acting as spring means, whereby, upon downward axial force being exercized on said actuating member to compress said foldable wall zone and thereby shortening said actuating member, said upper end of said actuating member forces said obturating member downward in unison therewith so that said obturating head is disengaged from said valve seat in downward direction and frees said tubular passage for product flow therethrough, and (d) fastening means on the outside of said actuating member being adapted for fixedly connecting said tubular actuating member, at a zone thereof below said elastically foldable wall zone, with said lid when said valve is mounted in said lid opening, said lid having about said lid opening an axially extending sleeve portion having an internal passage therethrough and radially outwardly recessed groove means therein in which said fastening means of said tubular actuating member are firmly lodged, said sleeve portion further having, downwardly from said groove means, a tubular portion snugly surrounding said substantially rigid lower end portion of the actuating member over substantially the entire length thereof, thereby enhancing the rigidity of the valve seat and ensuring a good seal with the obturating head in the closed position.

2. The discharge valve-and-lid assembly of claim 1, wherein said sleeve portion is downwardly dependent from said lid.

* * * * *